United States Patent [19]

Davidson

[11] 4,003,765

[45] Jan. 18, 1977

[54] HEAT TREATMENT OF COBALT BASE ALLOYS

[75] Inventor: James H. Davidson, Varennes-Vauzelles, France

[73] Assignee: Creusot-Loire, Paris, France

[22] Filed: Oct. 1, 1974

[21] Appl. No.: 511,093

Related U.S. Application Data

[63] Continuation-in-part of Ser. No. 316,716, Sept. 20, 1972, abandoned.

[30] Foreign Application Priority Data

May 4, 1972 France ..... 72.15818

[52] U.S. Cl. ..... 148/20.3; 75/171; 148/32.5; 148/158

[51] Int. Cl.[2] ..... C22F 1/02

[58] Field of Search ..... 148/158, 20.3, 32.5, 148/32; 75/171, 170

[56] References Cited

UNITED STATES PATENTS

| | | | |
|---|---|---|---|
| 2,974,037 | 3/1961 | Thielemann | 75/171 |
| 2,996,379 | 8/1961 | Faulkner | 75/171 |
| 3,418,111 | 12/1968 | Herchenroeder | 75/171 |

*Primary Examiner*—R. Dean

*Attorney, Agent, or Firm*—Cameron, Kerkam, Sutton, Stowell & Stowell

[57] ABSTRACT

Cobalt based alloy containing 5% to 30% Ni; 18% to 25% Cr; 5% to 17% of at least one of W, Ta and Mo; 0.10% to 0.30% C; 50 ppm to 200 ppm B; 0 to 0.3% Fe; 0 to 2% Mn; 0 to 1% HF; 0 to 1% La; 0 to 1% Y; 0.5% to 2% in total of Ti and/or Nb, the balance being Co; and a heat treatment for such alloy comprising solution heat treatment in a protective atmosphere at 1150° C to 1250° C for at least 1 hour, rapid cooling, and then age hardening for from 12 to 24 hours at from 750° C to 850° C to effect carbide precipitation of MC carbides, M being titanium or niobium.

2 Claims, 14 Drawing Figures

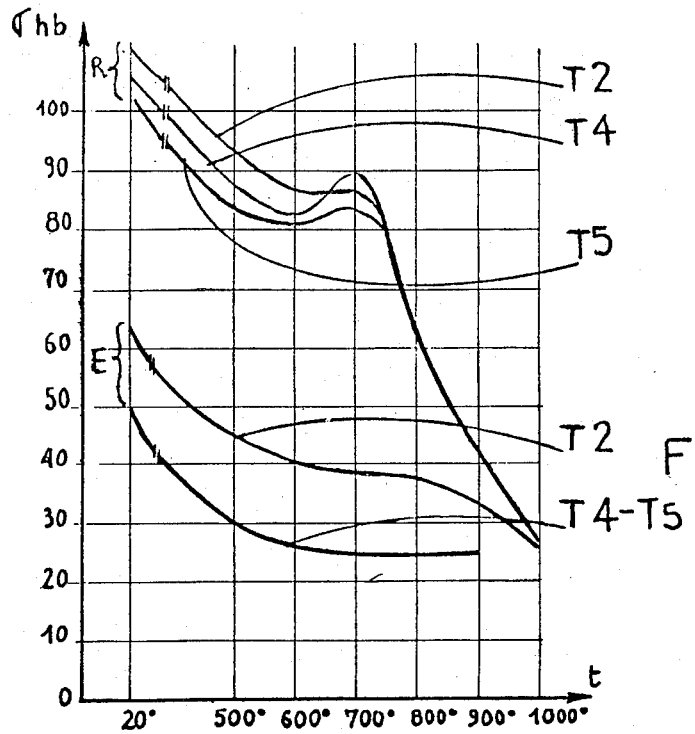
FIG:3
FIG:4
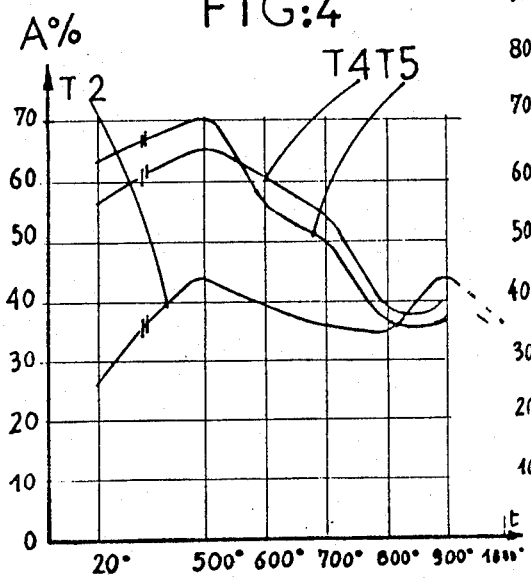
FIG:5
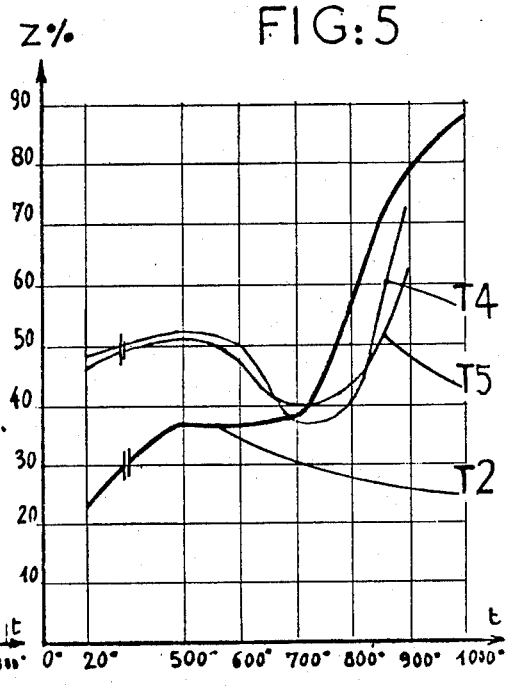

C. 1200°C 2h TE + 900°C 16h TA

Alliage 1. 1200°C 2h TE + 850°C 16h TA

HEAT TREATMENT OF COBALT BASE ALLOYS

This application is a continuation-in-part of application Ser. No. 316,716, filed 9/20/72 now abandoned.

This invention relates to an alloy of the kind normally called a "superalloy" which has a cobalt base and which was developed to have a high creep resistance and corrosion resistance at high temperature.

The alloy according to the invention which has these properties is of use more particularly in land and marine gas turbines, turboreactors and so on, inter alia in the construction of casings, flame tubes and combustion chambers of turbo-machinery. To facilitate the construction of welded hollow-ware for such uses, the alloy according to the invention has been developed to have good shapeability and good weldability, properties which are boosted by the slow hardening transformation in age hardening. The basic product mainly prepared from such an alloy is sheet metal.

Many cobalt-based alloys are known. Cobalt-based alloys for the purposes specified contain about 20% of chromium since chromium is essential for good hot oxidation resistance. Higher chromium contents reduce ductility considerably. Most of the known alloys also contain nickel to stabilize the austenitic structure and to reduce the tendency to form dense phases. The known alloys contain addition elements inter alia to produce hardening and improve creep resistance. The hardening of cobalt-based alloys usually proceeds from solid-solution hardening and from hardening by carbide precipitation. The hardening of cobalt-based alloys by the precipitation of intermetallic phases is at present being researched on a limited scale. It is completely conventional to add elements such as molybdenum, tungsten and tantalum for solid solution hardening. Elements which combine readily with carbon, such as titanium or niobium, are added for carbide precipitation hardening. Most cobalt-based alloys are not forgeable and are used in the as-cast state, but there are some forgeable cobalt-based alloys such as the one known variously as H A 25 or L 605 or ATGH, which contains from 19% to 21% of chromium, from 9 to 11% of nickel, from 46 to 53% of cobalt and the following addition elements: 14% to 16% of tungsten, 0.05% to 0.15% of carbon, 1% to 2% of manganese, less than 1% of silicon and less than 3% of iron. The mechanical properties of this alloy are obtained mainly by solid solution hardening. In the FCC matrix of these alloys are found $M_6C$ and $M_{23}C_6$ carbides. The $A_2B$ phase or Laves phase composed principally of $Co_2WSi$ forms during exposure periods at temperature.

Little structural hardening can be produced by subjecting this alloy to age hardening treatment after quenching. There is no intermetallic phase precipitation and little carbide precipitation. The alloy is therefore normally used in the solution-treated state. Another difficulty is that the supersaturation needed for abundant precipitation cannot be achieved by quenching in any appreciable thickness in a surface zone. This is a severe disadvantage for sheet metal. Also known are forgeable alloys produced by the combination of solid solution hardening, carbide precipitation hardening and structural hardening by precipitation of intermetallic phases. One such alloy, called J1570, contains 20% of chromium, 28% of nickel, 43% of cobalt and additional elements as follows: 7% of tungsten, 4% of titanium, and 0.20% of carbon. The titanium content is such as to lead to rapid hardening resulting from abundant precipitation of one phase $(Co, Ni)_3Ti$. The precipitation kinetics of this alloy are too fast to provide satisfactory weldability. An alloy disclosed by the French Patent No. 2,044,126 obviates this disadvantage by using a reduced titanium content.

The U.S. Pat. No. 3,418,111 relates to alloys, one corresponding to the commercial alloy HA188, which contain from 18% to 30% of chromium, from 8% to 30% of nickel, from 8to 18% of tungsten, from 0.01 to 0.35% of carbon, less than 10% of iron, from 0.02 to 2% of lanthanam, the balance being cobalt. The differences between the HA 188 Alloy and the HA 25 Alloy are in the amount of nickel, which is double, and the addition of lanthanam for resistance to oxidation. In the FCC matrix of these alloys are found $M_6C$,$M_{23}C_6$ carbides, Laves phases and the La counpound. These alloys are not heat treated.

The U.S. Pat. No. 2,996,379 describes alloys containing from 15 to 25% of chromium, less than 10% of nickel, from 10 to 15% of tungsten, less than 5% of molydenum, less than 0.70% of carbon, less than 3% of iron, less than 0.2% of boron. In a matrix rich in cobalt, a precipitation of carbides $Cr_{23}C_6$ assures the hardening of the alloy. Additions of titanium, magnesium, zirconium, calcium, barium, or vanadium are suggested to avoid precipitation of carbides $Cr_{23}C_6$ under lamellar form. Theses alloys are not heat treated.

The U.S. Pat. No. 2,974,037 describes alloys containing from 15 to 30% of chromium, less than 5% nickel, from 5 to 15% of tungsten, from 0.1 to 1.3% of carbon, less than 5% of iron, from 0.5 to 5% of niobium (or tantalium), from 0.01 to 0.2% of boron, the balance being cobalt. These alloys are used only for cast articles. They are not heat-treated.

It is an object of this invention to provide a cobalt-based alloy hardened conventionally by solid solution hardening and by carbide precipitation hardening and used for forged or rolled parts. The carbide precipitation hardening is very effective and is better than can be achieved in known alloys. The invention also relates to an appropriate heat treatment for such an alloy leading to optimum hardening by carbide precipitation. A surprising result is the provision of alloys whose creep resistance is better than the creep resistance of similar known alloys of larger grain size, since of course, ceteris paribus, reducing grain size tends to reduce the creep life of the alloy. A main feature of the invention is to provide a cobalt-based alloy having abundant precipitation even in the surface zones. The alloys according to the invention are on the whole better than known alloys for similar purposes, inter alia as regards hot ductility, deep-drawability and the kinetics of hardening by precipitation heat treatment.

These results are achieved with a composition containing, in percentages by weight, the balance being cobalt: from 18% to 25% of chromium, from 5% to 30% of nickel and from 5% to 17% of one or more of tungsten or tantalum or molybdenum, less than 0.3% of iron, from 0 to 2% of manganese, from 0 to 1% of hafnium from 0 to 1% of lanthanum, from 0 to 1% of yttrium, such composition being mainly characterised in that it contains from 0.10% to 0.30% of carbon, from 0.5% to 2% in total of titanium and or niobium and from 50 ppm to 200 ppm of boron. The heat treatment comprises solution heat treatment in a protective atmosphere at a temperature of from 1150° to 1250° C for at least 1 hour, followed by rapid cooling and age hardening for from 12 to 24 hours at from 750° C to 850° C to effect carbide precipitation.

The alloy according to the invention can be prepared in air or in vacuo with or without remelting in a consumable-electrode furnace in vacuo or under slag or by any combination of these processes.

The percentage of carbon and titanium and boron associated for the purposes of structural hardening by carbide precipitation are critical. As already stated, the weight percentage of these ingredients of the composition must be from 0.10% to 0.30% of carbon, from 0.5% to 2% of at least one of titanium or niobium and from 50 ppm to 200 ppm of boron. Titanium and niobium which are strong carbide-forming elements, form carbides of the type MC (M = Ti or Nb), which are thermodynamically stable and which favour hardening and creep. The addition of boron facilitates precipitation of numerous fine carbides and leads to an abundant precipitation even in surface zones. The carbon content must be above the stated minimum to ensure sufficient carbide precipitation. A carbon percentage much higher than the stated maximum would reduce alloy ductility and make the alloy difficult to forge. The boron content must be below the stated maximum to prevent the formation of low-melting point eutectics which would make the alloy difficult to forge. Similarly, the titanium content must be less than the stated limit, for higher values would lead to a hardening intermetallic phase of the $(Co,Ni)_3Ti$ kind.

The additions are equilibrated in titanium and (or) niobium and in carbon so that the ratio (Ti + Nb)/C is substantially equal to one when the additions are expressed in atomic percentages.

The optimum effect arising from precipitation of carbides is achieved by a composition based on the criteria hereinbefore defined and associated with an appropriate heat treatment. For instance, it has been found that raising the solution temperature of alloys according to the invention considerably improves their creep resistance performances. The solution treatment temperature effect is thought to be probably linked with re-solutioning of the primary carbides and with the increase in grain size.

Deep-drawability tests, however, show that deep-drawability plotted against the solution treatment temperature passes through a minimum. This may be the result of the opposite effects of increased grain size and the gradual resolutioning of the primary carbides. The solution treatment, which is given in practice at a temperature near 1200° C, therefore gives a compromise between various properties which such treatment affects in various ways. Alloys according to the invention must be given precipitation heat treatment after solutioning and quenching and the effect of such treatment is really important. Precipitation heat treatment after solutioning and quenching causes a considerable precipitation of carbides, providing very effective hardening. The optimum effect is obtained at a temperature around 800° C and for a time of the order of 16 hours. Resolutioning of the carbides becomes effective from 1100° C. Precipitation heat treatment improves the mechanical properties but should proceed slowly if the alloy is to be satisfactorily weldable. In fact, hardening occurs with this treatment only after about 100 minutes at 700° C or 800° C. Giving the treatment after rapid cooling from the solutioning temperature also boosts carbide precipitation. The reason for the advantageous effects of rapid cooling is that the vacancy concentration corresponding to the solutioning temperature is substantially retained. In practice, rapid cooling is provided by quenching in water.

The elastic limit of an alloy which has been given solution and age hardening treatment is appreciably higher than the elastic limit of an alloy which has been given solution treatment alone, but the ductility above 600° C or 700° C of an alloy which has been solution annealed, quenched rapidly and age hardened is less than the ductility of an alloy which has been only solution annealed and quenched rapidly. This difference may be due to carbides precipitating before or during testing. As in the case mentioned previously, the age hardening treatment must provide a compromise between different properties. Preferably, the treatments are given in a protective atmosphere, to reduce the risk of carbon and boron losses.

The improved cobalt-based alloy according to the invention which is aged by carbide precipitation also benefits from solid solution hardening. Experiments show that the combined presence of nickel and chromium in particular proportions improves hardening, stability and heat resistance of the cobalt. Actually, the additions of nickel and chromium to the cobalt are not independent of one another. The presence of iron tends to reduce hardening and the iron content must be limited. Increasing the cobalt tends to favour the hexagonal structure, whereas nickel acts as a stabilizer of the cubic face-centered structure as opposed to cobalt and elements such as chrome, molybdenum, tungsten and tantalum. The total content of these elements, which are added to harden the solid solution formed by the main elements, must be below the stated limit of 17%. Increasing their total content above 17% would favour the formation of embrittling phases; also an excess quantity of these elements, particularly tungsten and tantalum, which are very dense, would be detrimental to the density of the alloy.

As previously stated, the conventional step of adding chromium improves oxidation resistance, but the chromium content must not go beyond the upper limit, otherwise dense sigma type phases which may embrittle the alloy may appear. The alloys according to the invention can contain extra elements such as from 0 to 2% of manganese, for improved forgeability. They can contain from 0 to 1% of hafnium, from 0 to 1% of lanthanum, from 0 to 1% of yttrium to improve forgeability and oxidation resistance.

The following table gives the compositions of alloys prepared in accordance with the invention. The percentage by weight are as follows:

The contents by weight are preferably as follows: 0.15% to 0.25% of carbon, 19% to 21% of chromium, 9% to 11% of nickel, 14% to 16% of tungsten, less than 0.3% of iron, 0.5% to 2% of titanium and niobium, 50 ppm to 200 ppm of boron and a balance of cobalt.

A description will now be given of the properties of the alloys according to the invention with reference to the accompanying drawings in which:

FIG. 3 is a diagrammatic view of the results of experiments of alloy I which were conducted in vacuo to show the relationship between the temperature *t* and the elastic limits (curves E), and between the temperature *t* and the ultimate tensile strengths (curves R);

FIG. 4 shows the relationship between temperatures and the elongation A as a percentage measured in vacuo, used to evaluate ductility of alloy I solutioned at different temperatures, cooled and aged or not;

FIG. 5 shows the temperature *t* plotted against the reduction of area Z as a percentage measured in vacuo, used to assess ductility of alloy I solutioned at different temperatures, cooled, aged or not;

Figure 8:
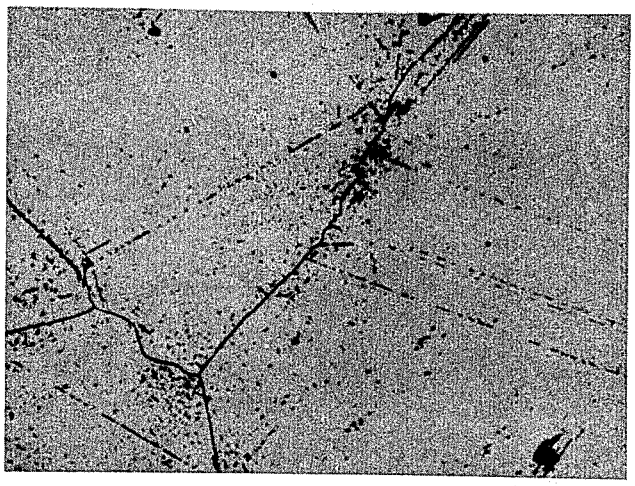
Figure 7:
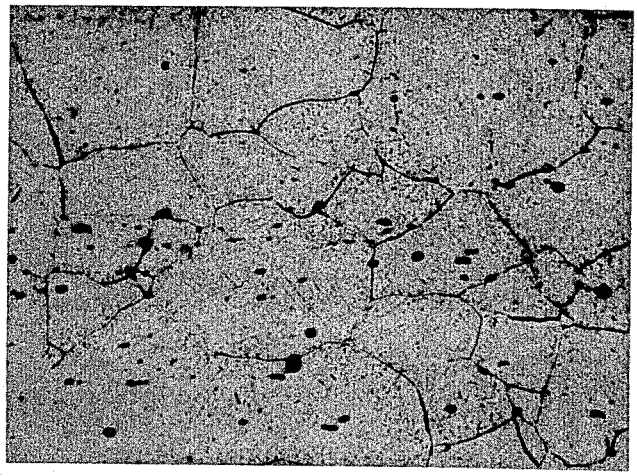
Figure 9:
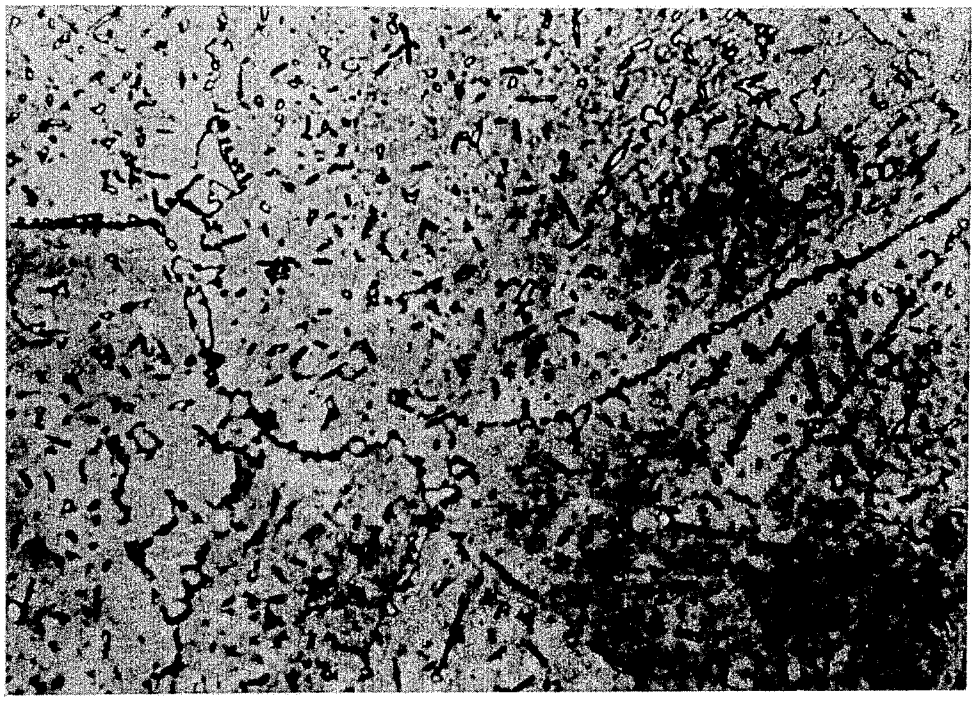
Figure 10:
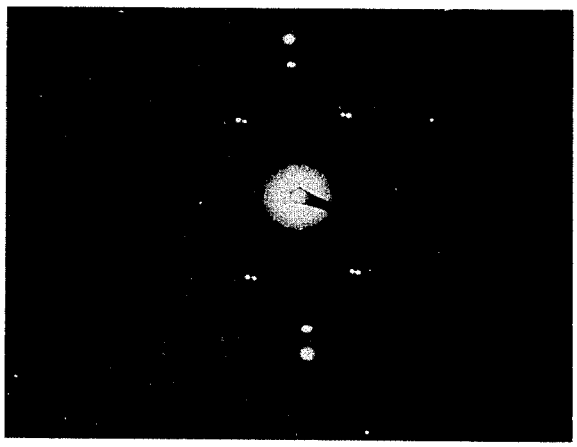
Figure 11:
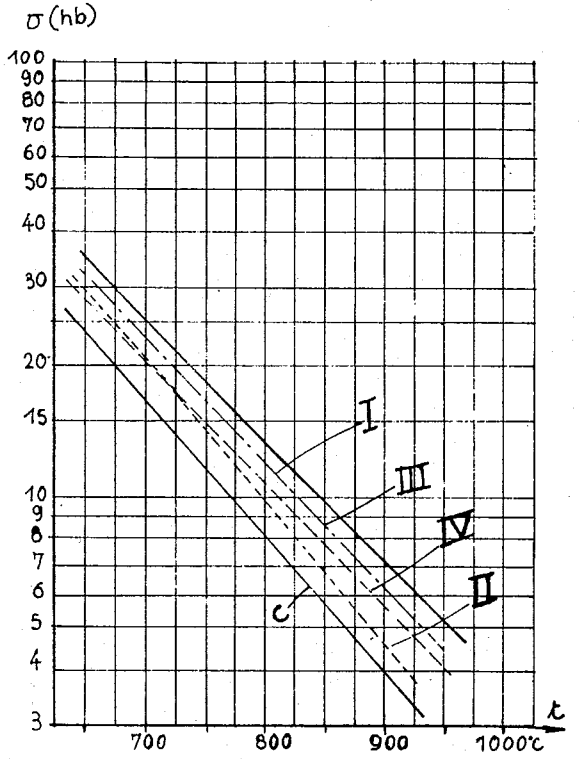

FIG. 7 est a photomicrograph showing microstructure of an alloy I according to the present invention at maximum hardening;

FIG. 8 is a photomicrograph showing microstructure of a known alloy;

FIG. 9 is a photomicrograph showing microstructure of alloy according to the present invention after a long exposure at temperature;

FIG. 10 is given by electron diffraction of titanium carbide;

FIG. 11 is a diagrammatic representation of creep tests of alloys I to IV which are heat treated according to the invention the stress in hb producing a 0.2% elongation after 100 hours being plotted against temperature *t;*

Figure 12:
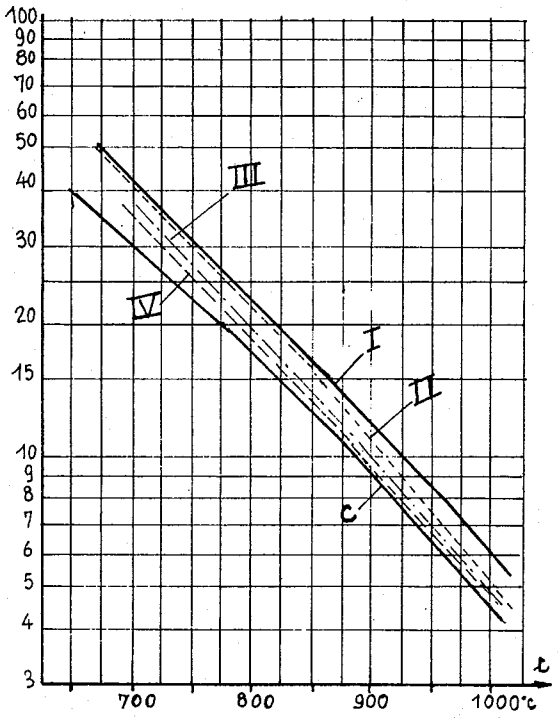

FIG. 12 is a diagrammatic representation of creep tests of alloys I to IV, which are heat treated according to the invention, the 100 hours stress-rupture strenghs being plotted against temperature *t;*

Figure 13:
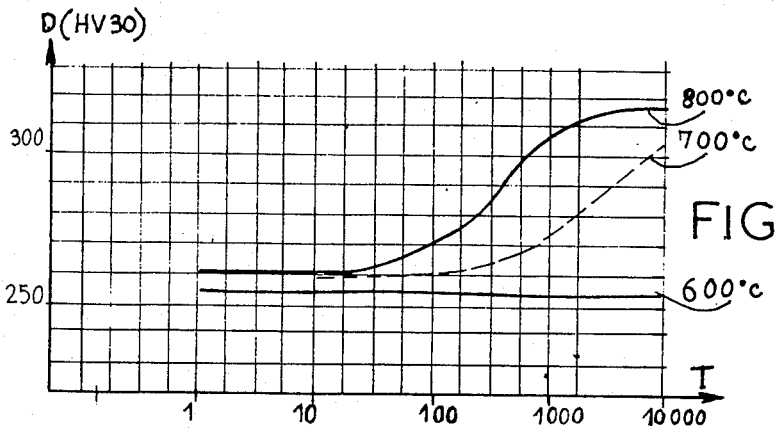
Figure 14:
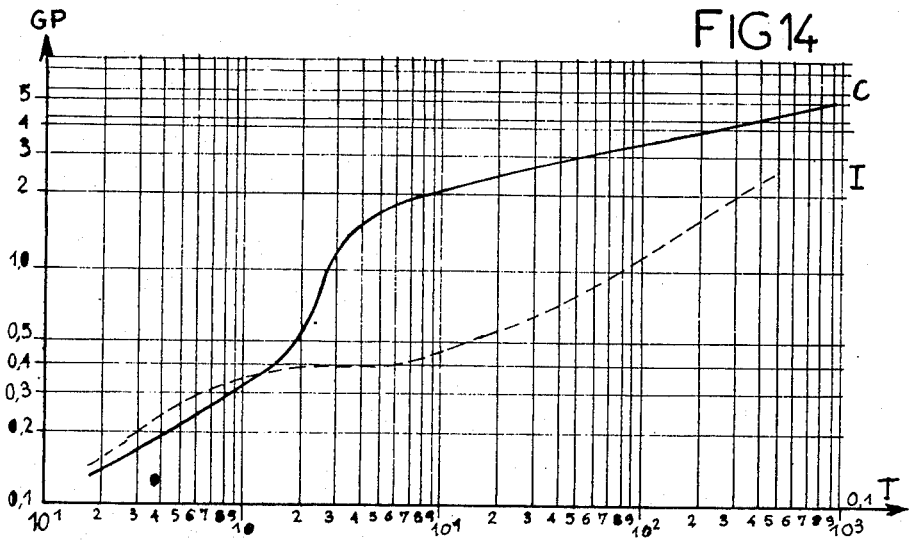

FIG. 13 shows the time T in minutes plotted against hardness D for precipitation heat treatment temperatures of 600°, 700° and 800° C;

FIG. 14 indicates the weight gain GP in mg/cm² plotted against the time T in hours for which a specimen was exposed to the air at 1000° C;

Referring to FIGS. 1 to 5, the references T1 to T5 for the various curves correspond to the following treatments applied to composition I:

| | | | | | |
|---|---|---|---|---|---|
| T1 | 1150° | 2 hr WC + | 800/825° C | 16 hr | AC |
| T2 | 1200° | 2 hr WC + | 800/825° C | 16 hr | AC |
| T3 | 1250° | 2 hr WC + | 800/825° C | 16 hr | AC |
| T4 | 1200° C | 2 hr WC | | | |
| T5 | 1250° C | 2 hr WC | | | |

wherein WC and AC denote water and air cooled, respectively.

The curves with the reference C are for a known alloy containing 0.10% of carbon, 10% of nickel, 20% of chromium, 15% of tungsten, and a balance of cobalt.

Figure 1:
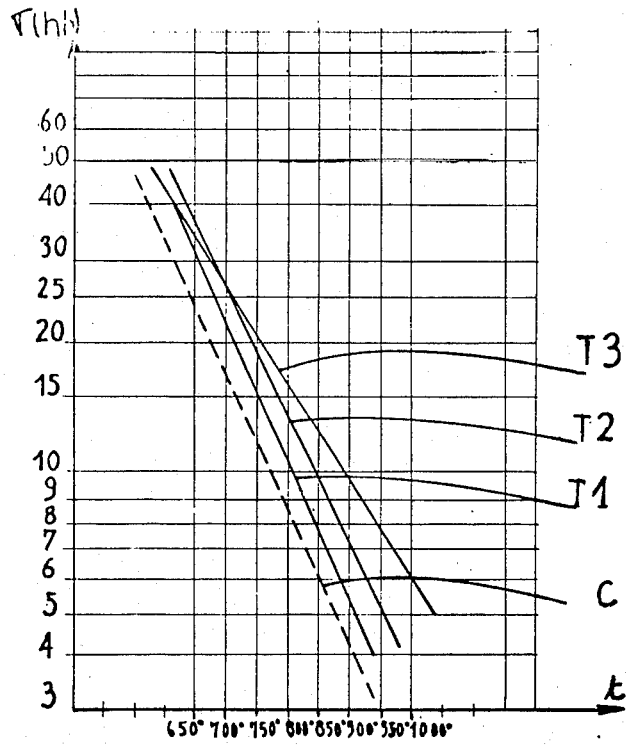
FIG. 1 is a diagrammatic representation of creep tests showing the stress in hb producing a 0.2% elongation after 100 hours, plotted against temperature *t* for alloy I, solutioned at different temperature, cooled and aged or not.
Figure 2:
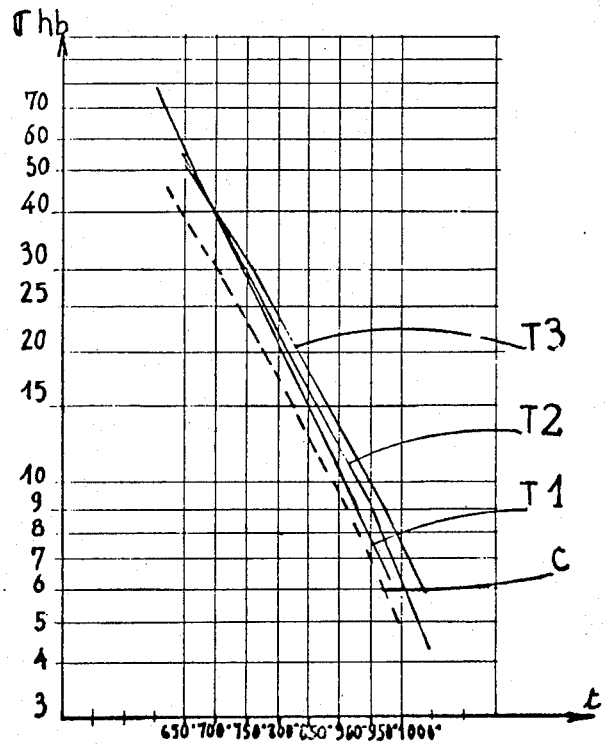
FIG. 2 is a diagrammatic representation of creep tests showing the 100 hours stress-rupture strenghs, plotted against temperature *t* for alloy I solutioned at different temperatures, cooled and aged or not.

FIGS. 1 and 2, show creep resistances of specimens of solution ed alloy I at 1150°, 1200° and 1250° C (curves 1, 2, 3 respectively), then quenched in water, then precipitation heat treated at from 800° to 825° C for 16 hours. Creep resistances are improved by increasing the solutioning temperature, the phenomenon probably being linked with resolutioning of the primary carbides and with increasing the grain size, although the latter changes only from 6 ASTM units at 1150° C to 4 or 5 ASTM units at 1250° C. These creep characteristics are better than those of known cobalt-based alloys.

FIG. 3 illustrates the ultimate tensile strength (curves R) and elastic limit (curves E) of the alloy I according to the invention, as determined by rapid tensile tests. A comparison of curves T2, T4 and T5 shows that precipitation heat treatment increases the elastic limit considerably. These properties are slightly better than in known alloys.

FIGS. 4 and 5 show the elongation curve A as a percentage and the reduction of area curve Z as a percentage, plotted against temperature. The figures show that the relative drop in hot ductility around 750° C due to precipitations is not very noticeable in the alloy according to the invention. The figures also show the slightly adverse effect on ductility of the solutioning temperature, which is usually a compromise between various properties of the metal when hot. A comparison of the results between the solutioned and quenched states (T4, T5) alone and the solutioned, quenched and precipitation heat treated state T2 suggests that the reason for the drop in ductility from 600° to 700° C is the precipitation of carbides before or during testing.

Figure 6:
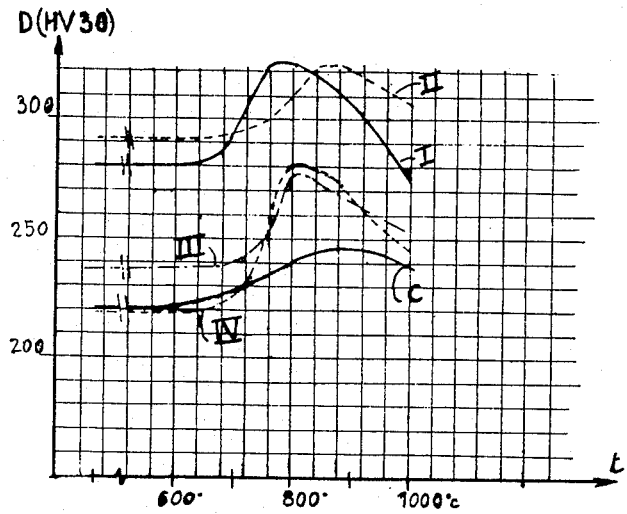
FIG. 6 shows the hardening D of alloys in Vickers units, plotted against the tempering temperature *t;*

FIG. 6 shows, plotted against the precipitation heat treatment temperature, the hardness of alloys I, II, III, IV produced by 16 hours of precipitation heat treatment given after solution heat treatment at 1200° C for 2 hours (quenching in water). The hardening of all alloys due to carbide precipitation, is at a maximum around 800° C. Resolutioning is effective around 1100° C.

FIG. 7 shows the microstructure of alloy I at maximum hardening after a solution heat treatment at 1200° C during 2 hours, water quenching, followed by age hardening at 850° C for 16 hours. There is an abundant and homogeneous precipitation of fine carbides MC (M = Ti or Nb). The grain size is finer than in the known alloy shown in FIG. 8.

FIG. 10 shows that TiC carbide is identified in the alloy according to the invention.

FIG. 9 relates to alloy I treated according to the aforesaid treatment which leads to maximum hardening, then exposed at 900° C for 1000 hours under stress. The carbides MC are stable and this treatment leads only to the growth of a Laves phase precipitation.

FIGS. 11 et 12 show creep resistances of compositions I, II, III, IV which are solutioned at 1200° C for 2 hours, then water cooled, then aged at 800° for 16 h and air cooled. The superiority of alloys II, III, IV over the alloy C is perceptible as for times, for a low given alongement. However in the case of compositions III and IV which contain molybdenum, the density is lower (about 8.4g/cm³ against about 9.1 for alloys containing W).

Hardening proceeds slowly enough to ensure satisfactory weldability. For instance, as FIG. 13 shows, age hardening of the alloy I according to the invention occurs only after about 100 minutes at 700° or 800° C.

The improvement in high temperature properties is achieved without impairing oxidation resistance as compared with known cobalt-base alloys; as FIG. 8 shows, the alloy I according to the invention (curve I) gains weight slower than the known alloy.

Deep-drawability tests were made on 2 mm thick sheets of alloy I in the 1150°, 1200° and 1250° C solution treated states. Another series of tests was run to compare the behaviour of the new alloy with the behaviour of the known alloy and to find out more about the effect of precipitation heat treatment. The results are summarised in the following table II. The deep-drawability values correspond to maximum penetration of the punch until the appearance of the first crack. The alloy according to the invention compares very favourably with the known alloy. Deep-drawability passes through a minimum when the solution-treatment temperature increases, probably because of opposite effects of increasing grain size and gradual resolutioning of the primary carbides.

TABLE II

| STATE | Thickness (mm) Known Alloy | Alloy I |
|---|---|---|
| 1150° C 2 hr WC | | 2.77 |
| 1200° C 2 hr WC | | 2.63 |
| 1250° C 2 hr WC | | 3.27 |
| 1200° C 2 hr WC | 2.88 | 2.92 |
| 1200° C 2 hr WC + 700° C 16 hr FR* | 3.27 | 3.22 |
| 1200° C 2 hr WC + 800° C 16 hr FR* | 2.27 | 1.93 |
| 1200° C 2 hr WC + 900° C 16 hr FR* | 1.65 | 2.01 |

*FR denotes slow cooling, such as of about 100° C per minute.

I claim:

1. A process of heat treating an alloy consisting in: preparing an alloy consisting of, in percentages by weight, from 5 to 30% nickel
from 18 to 25% chromium,
from 5 to 17% in total of one or more of tungsten, tantalum, and molybdenum,
from 0.10 to 0.30% carbon,
from 50 to 200 ppm boron,
from 0 to 0.3% iron
from 0 to 2% manganese,
from 0 to 1% hafnium,
from 0 to 1% lanthanum,
from 0 to 1% yttrium,
from 0.5 to 2% in total of titanium and/or niobium, the balance being cobalt and incidental impurities, solution heat treating the alloy in a protective atmosphere at from 1150° to 1250° C for at least 1 hour, and rapid cooling and then age hardening for from 12 to 24 hours at from 750° C to 850° C, to effect carbide precipitation of MC carbides, M being titanium or niobium.

2. A process of preparing an alloy according to claim 1, in which the additions of carbon, niobium and titanium are chosen so that the ratio (Ti + Nb)/C is substantially equal to one when the additions are expressed in atomic percentage.

* * * * *